US006786481B2

(12) United States Patent
Kawai et al.

(10) Patent No.: US 6,786,481 B2
(45) Date of Patent: Sep. 7, 2004

(54) SHEET FEEDING DEVICE

(75) Inventors: Takamitsu Kawai, Aichi-ken (JP); Koji Takito, Aichi-ken (JP); Yukio Shiohara, Aichi-ken (JP); Takatoshi Takemoto, Aichi-ken (JP); Hiroshi Suzuki, Aichi-ken (JP); Tetsuya Ouchi, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 13 days.

(21) Appl. No.: 10/225,499

(22) Filed: Aug. 22, 2002

(65) Prior Publication Data

US 2003/0038419 A1 Feb. 27, 2003

(30) Foreign Application Priority Data

Aug. 22, 2001 (JP) ..... 2001-250935
Aug. 27, 2001 (JP) ..... 2001-256503

(51) Int. Cl.[7] ..... B65H 3/06
(52) U.S. Cl. ..... 271/109; 271/114
(58) Field of Search ..... 271/109, 114; B65H 3/06

(56) References Cited

U.S. PATENT DOCUMENTS 5,720,477 A * 2/1998 Morita et al. ..... 271/117

FOREIGN PATENT DOCUMENTS

| | | | |
|---|---|---|---|
| JP | A 61-106347 | 5/1986 | |
| JP | A 4-3735 | 1/1992 | |
| JP | A 8-319037 | 12/1996 | |
| JP | A 10-35930 | 2/1998 | |
| JP | A 10-250862 | 9/1998 | |
| JP | A 11-29245 | 2/1999 | |
| JP | 2000-95364 | * 4/2000 | ..... B65H/3/06 |
| JP | 2001-278507 | * 10/2000 | ..... B65H/9/14 |
| JP | 2001-139169 | * 5/2001 | ..... B65H/3/06 |

* cited by examiner

*Primary Examiner*—Donald P. Walsh
*Assistant Examiner*—Kenneth W Bower
(74) *Attorney, Agent, or Firm*—Oliff & Berridge, PLC

(57) ABSTRACT

There is provided a sheet feeding device, which is provided with a paper supply member which feeds a sheet of paper on the top of stack of paper, the paper supply member being actuated by an actuator. The sheet feeding device further provided with a control system which controls the paper supply member, the control system having a stable sheet feeding operation mode in which the control system drives the paper supply member for a first time period initially, then stops the paper supply member after the first time period terminates, and then drives the paper supply member for a second time period.

20 Claims, 13 Drawing Sheets

NORMAL MODE
PLAIN PAPER

NORMAL MODE
THICK PAPER

FIRST STABLE
MODE

NORMAL MODE
PLAIN PAPER

NORMAL MODE
THICK PAPER

SECOND STABLE
MODE

NORMAL MODE
PLAIN PAPER

SECOND STABLE
MODE(1)

SECOND STABLE
MODE(2)

SECOND STABLE
MODE(3)

SECOND STABLE
MODE(4)

SECOND STABLE
MODE(5)

SECOND STABLE
MODE(6)

SHEET FEEDING DEVICE

BACKGROUND OF THE INVENTION

The present invention relates to a sheet feeding sheet feeding device for a printer or the like. More specifically, the present invention relates to control of a sheet supply roller provided in the sheet feeding device.

Generally, a printer such as an inkjet printer employs a sheet feeding device, which holds a plurality of sheet in a stacked manner, and feeds the sheets into the printer one by one along a sheet feed path thereof. Such a sheet feeding device generally includes a sheet supply roller, which is typically driven by a stepping motor.

When held by the sheet feeding device, the plurality of stacked sheets are inclined with respect to the vertical direction, and the leading end of the plurality of sheets are abutted against a sheet separating plate, which generally has a surface formed of minute volley and ridge portions extending perpendicular to the sheet feeding direction so as to have relatively high friction coefficient. The sheet supply roller is arranged to contact the top one of the stacked sheet. As the sheet supply roller rotates, the leading end of the top sheet is moved against the frictional force, and fed along the sheet feed path.

Such a configuration may cause a problem as follows.

If the leading end of the top sheet is engaged with the volley portion formed on the sheet separating plate, and the sheet supply roller is rotated to separate the top sheet, the leading end may not move at an initial stage and then may be suddenly released from the volley portion. In such a case, the leading end of the top sheet may move excessively in the feeding direction. In addition, since the sheet supply roller is generally biased to the stack of sheets and configured to be movable in a direction away from the sheets, sheet feeding due to the above-described movement of the top sheet, the sheet supply roller may be lifted by an impact force of the top sheet.

In addition, the sheet supply roller may be deteriorated with age, and in such a case, the sheets may not be fed properly. In another case, if the leading end of the sheet is curved, the sheet may not be properly fed.

SUMMARY OF THE INVENTION

The present invention is advantageous in that it provides a sheet feeding device and a method with which a top sheet is stably separated from a stack of sheets.

According to an embodiment, there is provided a sheet feeding device which feeds a stack of sheets one by one along a sheet feed path. The sheet feeding device includes a sheet driving member that separates and drives one sheet of the stack of sheets in the sheet feed direction, and a control system that controls the sheet driving member to move the one sheet at least in a first mode that is followed by a second mode. The control system controls the sheet driving member to move the one sheet at a first speed in the first mode, and at a second speed in the second mode. The first speed is smaller than the second speed.

With this configuration, it is ensured that the top sheet of the stacked sheets is properly separated when the second mode starts.

Optionally, predetermined stop time is provided between the first mode and the second mode, and the sheet driving member stops moving the one sheet during the predetermined stop time.

Further optionally, the predetermined stop time may be varied in accordance with a thickness of the sheet to be fed.

Still optionally, at least one of the first and second speed may be changed in accordance with a thickness of the sheet to be fed.

According to embodiments, the sheet feeding device further includes a separating plate located on downstream side, with respect to a sheet feed direction, of the stack of sheets. Leading ends of the stack of sheets are abut against a surface of the separating plate. The surface of the separating plate is formed to be a rough surface. The one sheet to be fed is a top sheet of the stack of sheets, and the sheet driving member contacts the top sheet of the stack of sheets. The sheet driving member is driven to move the top sheet in the sheet feed direction.

According to embodiments, the sheet feeding device is configured to feed the leading end of the top sheet from a first position which is on the sheet separating plate to a predetermined registration position, the leading end being detached from the sheet separating plate at located at a second position at an end of drive in the first mode, the leading end being moved from the second position to the predetermined registration position during the second mode.

In this case, the sheet feeding device is further provided with a registration sensor that detects absence/presence of a sheet, the registration sensor being provided at a third position which is located between the second position and the predetermined registration position.

Optionally, the control system judges an occurrence of a sheet feed error based on the operation mode and a status detected by the registration sensor.

If the registration sensor detects presence of a sheet at the end of operation in the first mode, the control system judges an occurrence of a sheet feed error. In this case, a notification of the occurrence of the error may be issued. In particular, in the above case, since the sheet is already located at the registration sensor, it is preferable that the sheet is fed and discharged.

In an alternative case, if the registration sensor does not detect presence of a sheet by the end of operation in the second mode, the control system judges an occurrence of a sheet feed error.

According to another aspect of the invention, there is provided a sheet feeding device which feeds a stack of sheets one by one along a sheet feed path. The sheet feeding device further includes a sheet driving member that separates and drives one sheet of the stack of sheets in the sheet feed direction, and a control system that controls the sheet driving member to move the one sheet from a stacked position to a predetermined registration position, the control system being selectively operates in a first feeding mode and a second feeding mode. In this case, the control system controls the driving member to move the one sheet in a first mode that is followed by a second mode when the first feeding mode is selected, the control system controls, in the first feeding mode, the sheet driving member to move the one sheet at a first speed in the first mode, and the sheet driving member to move the one sheet at a second speed in the second mode. In this case, the first speed is slower than the second speed.

Optionally, the control system controls the driving member substantially at a constant speed in the second feeding mode.

Further optionally, the control system may control the driving member to move the one sheet in a third mode that is followed by a fourth mode when the second feeding mode is selected, and the control system controls, in the second feeding mode, the sheet driving member to move the one sheet at a third speed in the third mode, and the sheet driving member to move the one sheet at a fourth speed in the fourth mode.

In a particular case, the third speed is slower than the second speed.

Still optionally, at least one of the constant speed, first speed and second speed may be changed depending on a thickness of a sheet to be fed.

Further optionally, a predetermined stop time is provided between the first mode and the second mode, and the sheet driving member stops moving the one sheet during the predetermined stop time.

In this case, the predetermined stop time may be varied in accordance with a thickness of the sheet to be fed.

The sheet feeding device may further include a sheet feed error detection system, and a storage that accumulatively stores the number of occurrences of the sheet feed error.

In this case, the control system may select one of the first feeding mode and the second feeding mode in accordance with the accumulated number of occurrences of the sheet feed error.

Optionally, the control system may select the first feeding mode if the number of occurrences of subsequent sheet feed errors reaches a predetermined value.

According to embodiments, there is provided a method of feed a stack of sheets one by one from the stack to a predetermined registration position along a sheet feed path of a sheet feeding device. The method includes driving one sheet of the stack of sheets in the sheet feed direction to a position upstream side of the predetermined registration position at a first speed, and driving one sheet in the sheet feed direction to the predetermined registration position at a second speed which is different from the first speed.

With this method, it is ensured that the top sheet of the stack of sheets is properly separated and fed. The method can be stored in a storage medium as a program which can be executed by a computer system.

Optionally, the first speed is slower than the second speed.

According to embodiments, there is provided a method of feed a stack of sheets one by one from the stack to a predetermined registration position along a sheet feed path of a sheet feeding device, which includes driving one sheet of the stack of sheets in the sheet feed direction to a position upstream side of the predetermined registration position at a first speed, stopping the one sheet to move for a predetermined period of time, and driving the one sheet in the sheet feed direction to the predetermined registration position at a second speed which is different from the first speed.

With this method, it is also ensured that the top sheet of the stack of sheets is properly separated and fed to the registration position. The method can be stored in a storage medium as a program which can be executed by a computer system.

BRIEF DESCRIPTION OF THE ACCOMPANYING DRAWINGS

Figure 7:
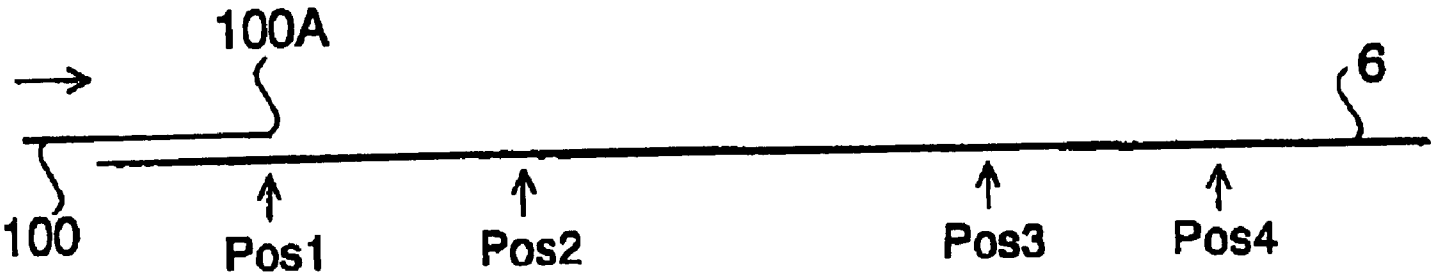
Figure 8:
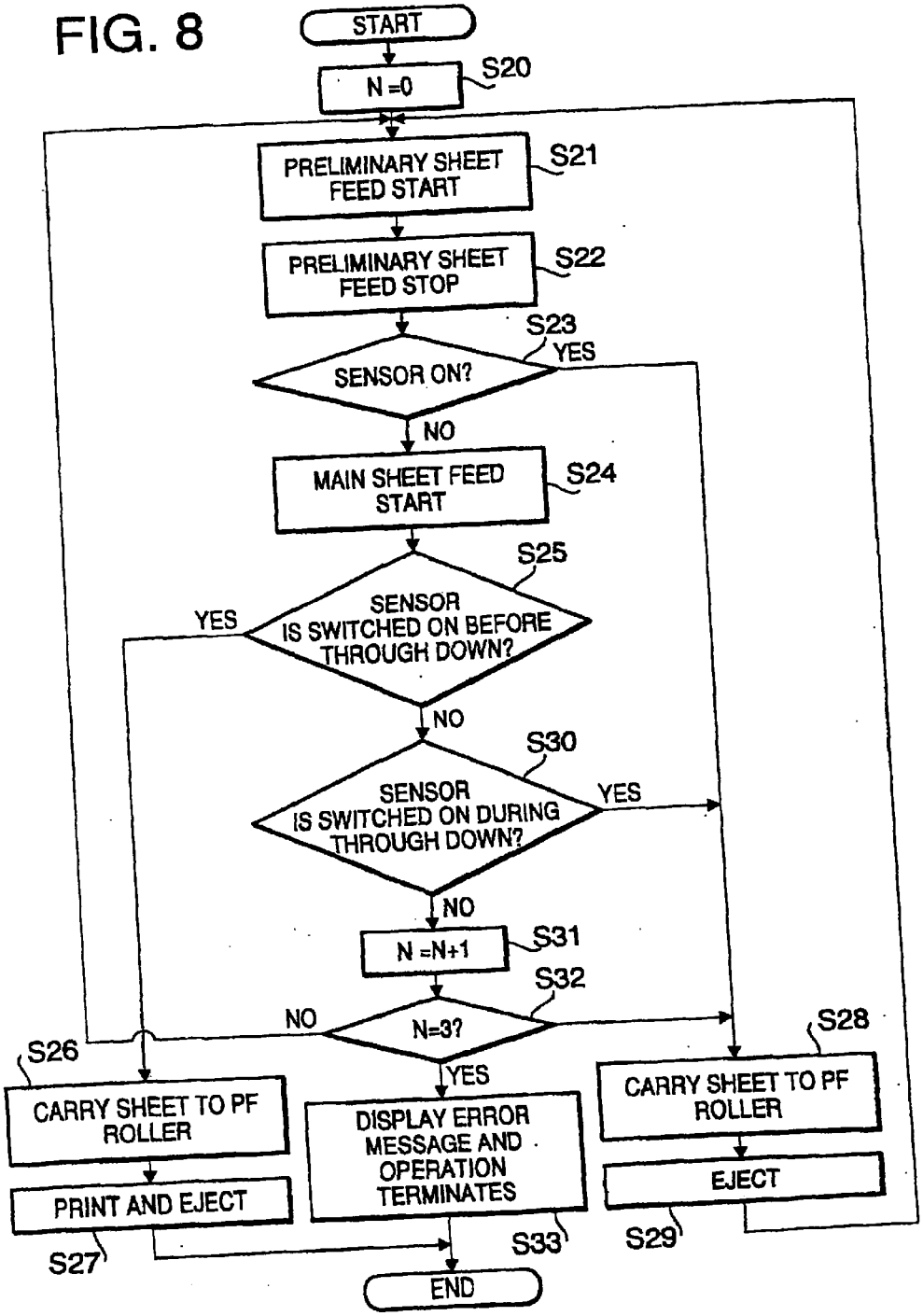
Figure 10A:
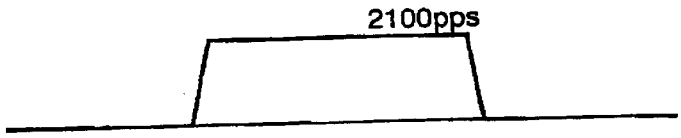
Figure 10B:
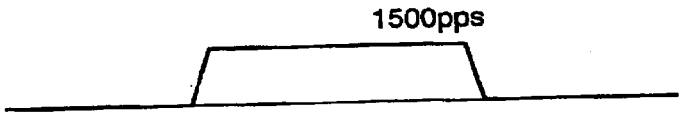
Figure 10C:
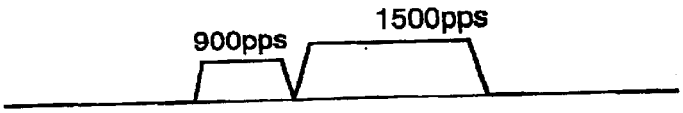
Figure 11A:
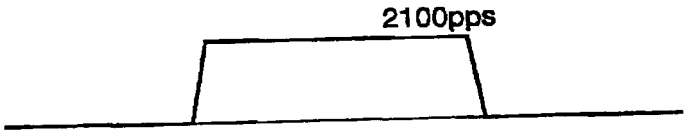
Figure 11B:
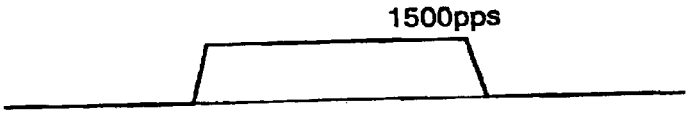
Figure 11C:
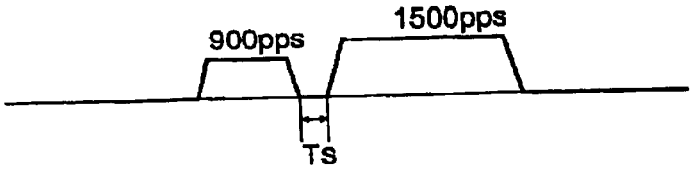

FIG. 7 schematically shows various positions of a leading end of a sheet along a sheet feed path;

FIG. 8 is a flowchart showing a sheet feeding and printing operation of the sheet feeding device according to a second embodiment;

FIGS. 9A–9E are timing charts showing operation of the sheet feeding device according to the second embodiment;

FIGS. 10A–10C are timing charts showing control of the stepping motor in a first stable sheet feeding operation mode, according to a third embodiment of the invention;

FIGS. 11A–11C are timing charts showing control of the stepping motor in a second stable sheet feeding operation mode, according to the third embodiment of the present invention.

Figure 12:
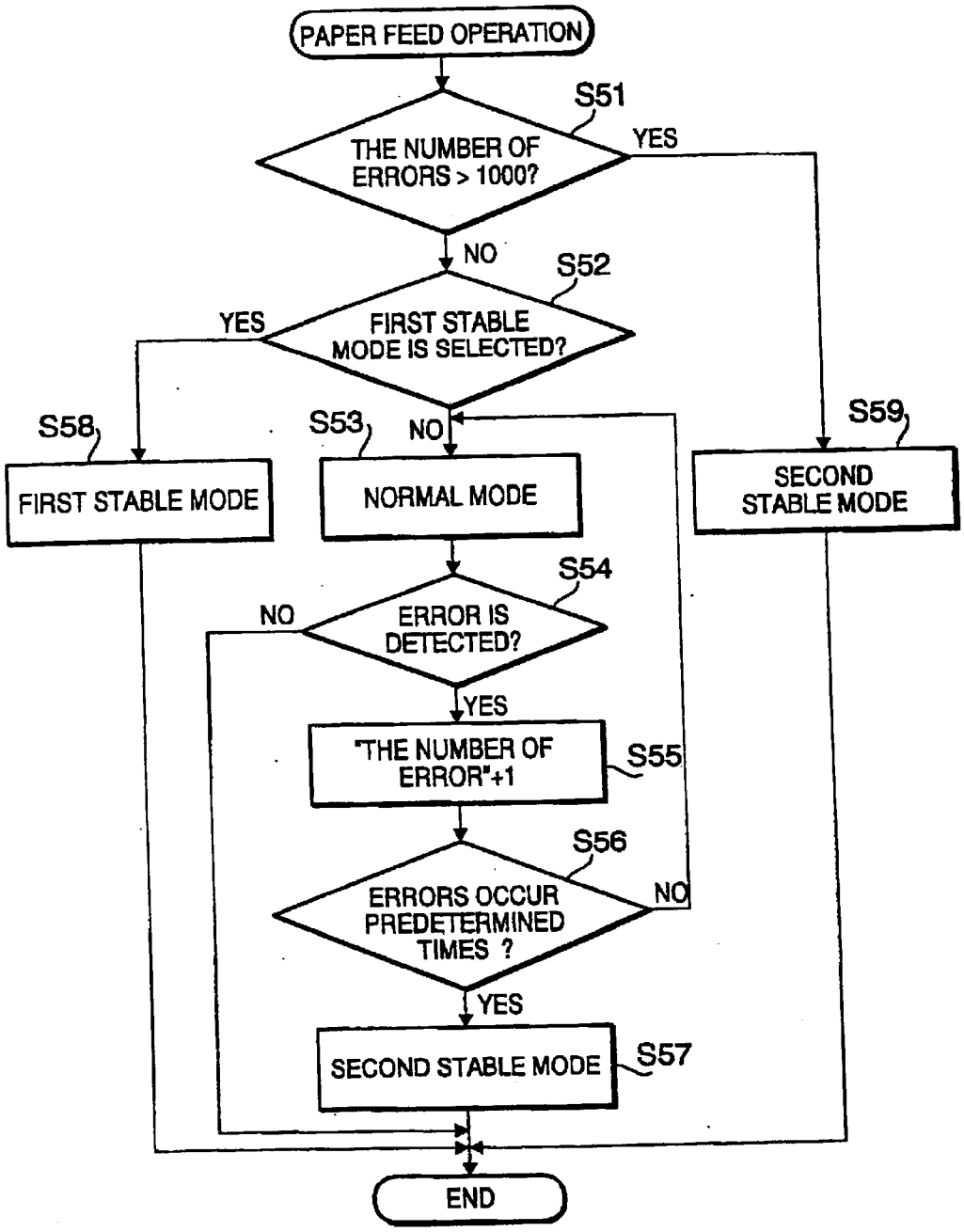
Figure 13A:
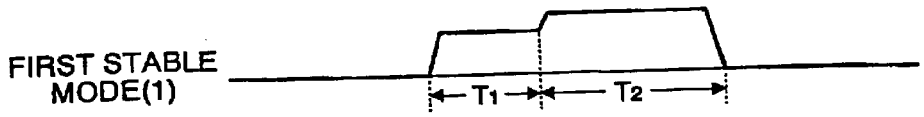
Figure 13B:
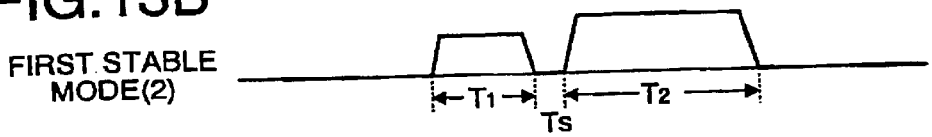

FIG. 12 is a flowchart showing sheet feeding operation of the sheet feeding device, according to the third embodiment of the present invention;

FIGS. 13A–13B show variations with regard to the first stable sheet feeding operation mode shown in FIG. 10C;

FIGS. 14A–14D are timing charts showing variations of the control of the stepping motor in the first stable sheet feeding operation mode shown in FIG. 10C; and FIGS. 15A–15G show variations with regard to the second stable sheet feeding operation mode shown in FIG. 11C.

DETAILED DESCRIPTION OF THE EMBODIMENTS

Hereinafter, embodiments of the invention will be described with reference to the accompanying drawings.

First Embodiment

Figure 1:
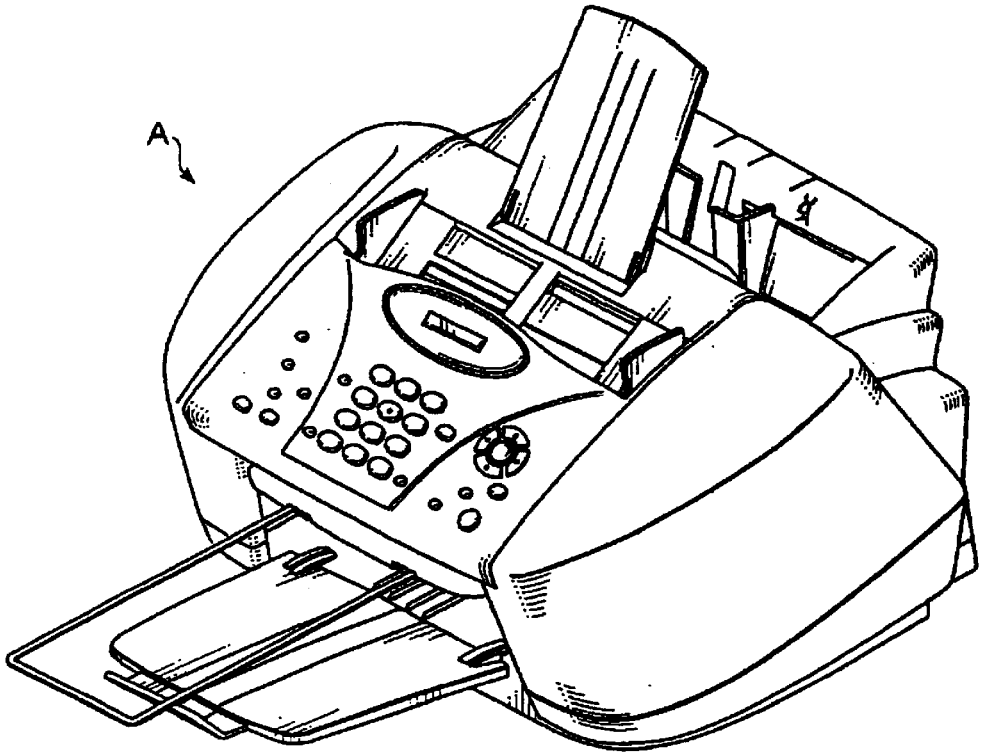
FIG. 1 shows a perspective view of a facsimile apparatus employing a sheet feeding device according to an embodiment of the invention.

A first embodiment will be described with reference to FIGS. 1–7. FIG. 1 shows a perspective view of a facsimile apparatus A employing a sheet feeding device 10 according to an embodiment of the invention. The facsimile apparatus A includes a printing device employing an inkjet printing method (hereinafter, referred to as an inkjet printer), an image reading device (hereinafter, referred as a scanner), a transmitting device and the like.

The facsimile apparatus A is configured such that, when connected to a personal computer of the like, the facsimile apparatus A functions as the inkjet printer and/or scanner. Further, the facsimile apparatus A functions as a copier since an image can be read using the scanner, and the scanned image is printed using the printer. In the description hereafter, since the scanner and/or transmission function are not essential in view of the present invention, description thereof is omitted. While, the invention mainly relates to the sheet feeding function, which will be described in detail.

Figure 2:
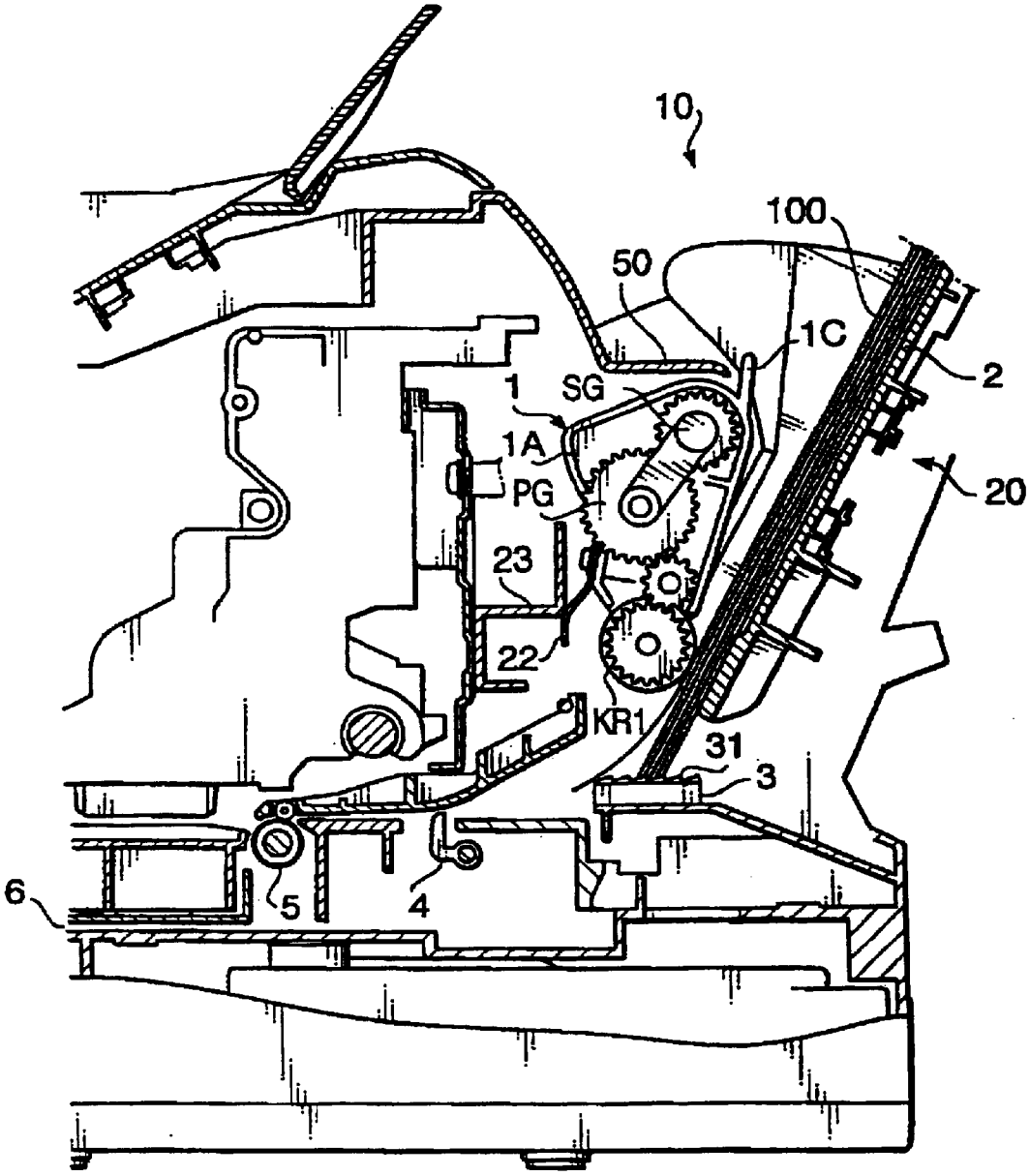
FIG. 2 is a side view showing a mechanism for feeding a sheet in the facsimile apparatus shown in FIG. 1.
Figure 3:
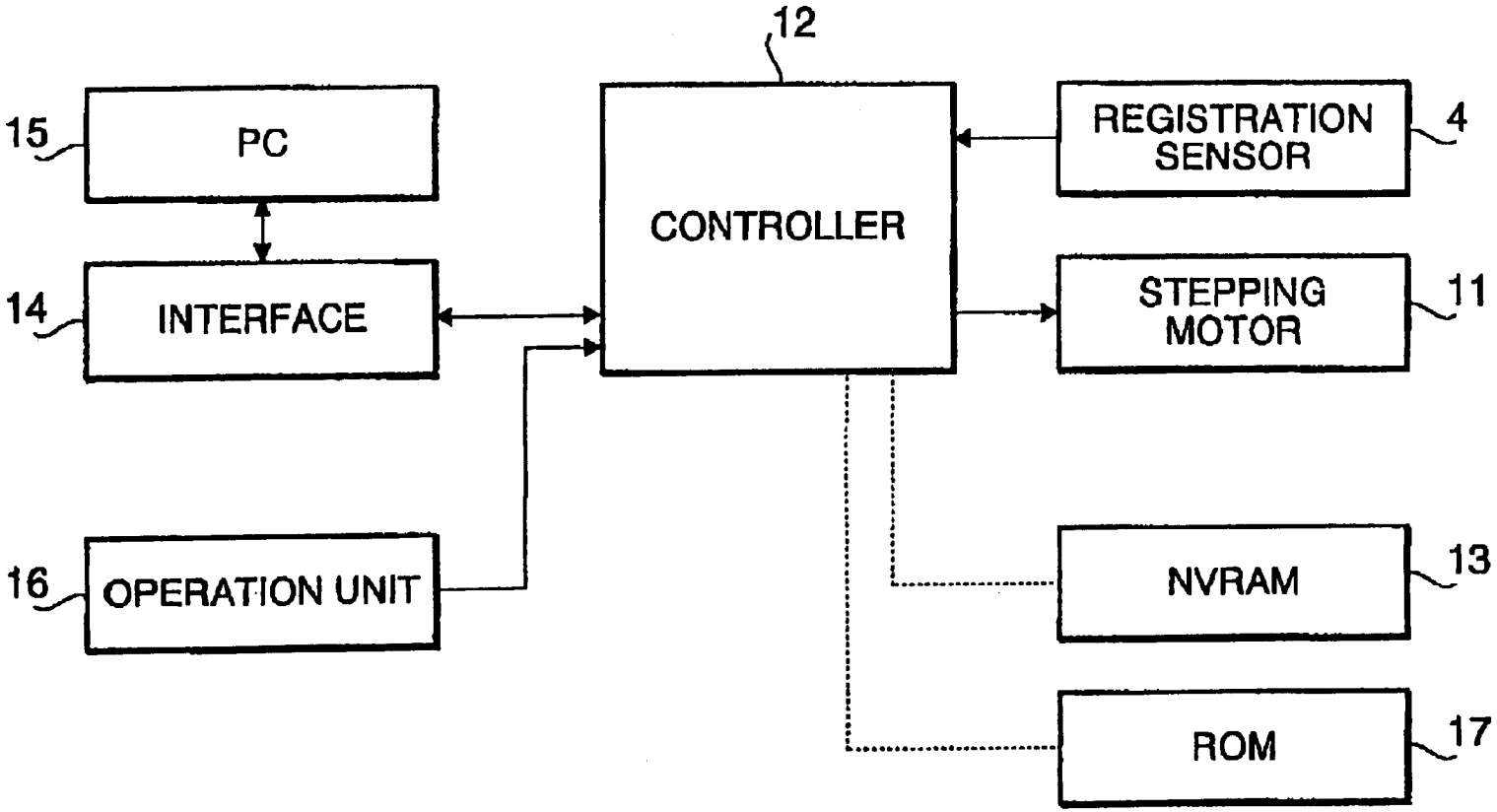
FIG. 3 is a block diagram illustrating a control system of the sheet feeding device.

FIG. 2 is a side view showing a mechanism for feeding a sheet in the facsimile apparatus A shown in FIG. 1. FIG. 3 shows a block diagram of a control system of the sheet feeding device 10.

As shown in FIGS. 2 and 3, the sheet feeding device 10 is provided with the sheet separating unit 1, a supporting plate 2 and a sheet separating plate 3. The sheet separating unit 1 separates a top sheet of a plurality of sheets 100 and feeds the separated sheet along a sheet feed path. The stacked sheets are supported by the supporting plate 2 in a slanting direction (i.e., a direction inclined with respect to the vertical direction). The leading ends of the stacked sheets 100 contact the sheet separating plate 3. The top surface, on which the leading ends of the stacked sheets 100 contact, is formed to have a rough surface. Specifically, minute volley and ridge portions extending in a direction perpendicular to the sheet feed path 6 are alternately formed.

Further, the sheet feeding device 10 is provided with a registration sensor 4 and a sheet feed roller 5 along the sheet feed path 6, from an upstream side to a downstream side. The registration sensor 4 detects presence/absence of a sheet at a position where it is provided. As a sheet is fed from the upstream side and reaches the registration sensor 4, the detection status of the registration senor 4 is changed. Thus, it is possible to detect that the leading end of a sheet 100 has reached the position of the registration sensor 4. The sheet feed roller 5 catches the leading end portion of the sheet 100 fed from its upstream side, and withdraws the same to further feed the sheet 100 along the sheet feed path 6.

Figure 4B:
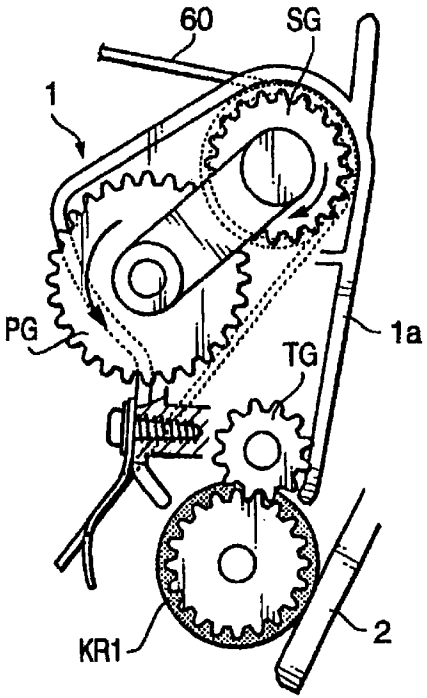
FIGS. 4A and 4B show a structure for driving a sheet supply roller.
Figure 4A:
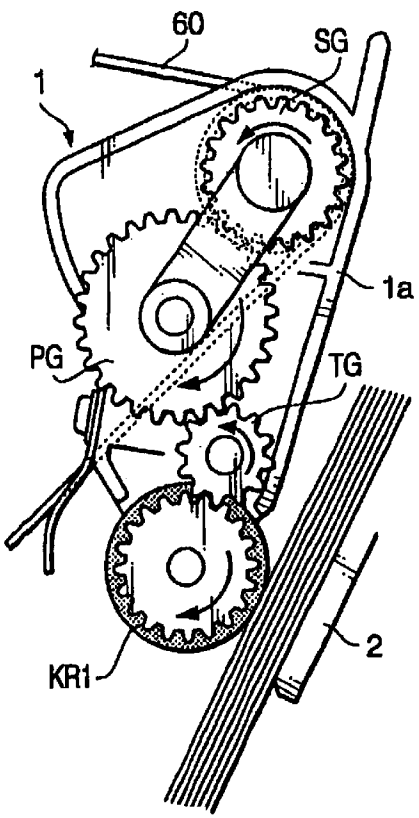

As shown in FIGS. 2, 3, 4A and 4B, the sheet separating unit 1 is provided with an arm member 1*a*, a sun gear SG, a planetary gear PG meshing with the sun gear SG, a trailing gear TG arranged to mesh with the planetary gear PG, and a sheet supply roller KR1 meshing with the trailing gear PG. The sun gear SG is coupled to a drive shaft of the paper separating unit 1, which is actuated by an actuator (not shown in FIG. 2). The sheet supply roller is biased to rotate toward the sheets 100 about the drive shaft of the paper separating unit 1 by a spring-member 60 as shown in FIGS. 4A and 4B.

A drive force generated by a stepping motor 11 is transmitted through a driving mechanism (not shown), which rotates the sun gear 5G and the sheet feed roller 5.

As shown in FIG. 4A, when the stepping motor 11 rotates in one direction (which will be referred to as a first direction), the sun gear SG rotates counterclockwise, and therefore, the planetary gear PG meshes with the trailing gear TG. Accordingly, the sheet supply roller KR1 rotates clockwise and it moves a top sheet of the stack of sheets 100 toward the separating plate 3. The sheet feed roller 5 rotates clockwise while the stepping motor 11 rotates in the first direction.

When the stepping motor 11 rotates in a second direction which is opposite to the first direction, the sun gear SG rotates clockwise, and therefore the planetary gear PG separates from the trailing gear TG, as shown in FIG. 4B. In this case, the sheet supply roller KR1 is not driven by the drive force generated by the stepping motor 11, and therefore, the sheet supply roller KR1 is set free. The sheet feed roller 5 rotates counterclockwise while the stepping motor rotates in the second direction.

As shown in FIG. 2, a plate spring 22 is attached to a holder 1A of the paper separating unit 1. The plate spring 22 contacts a structural element 23 of the facsimile apparatus A when a sheet stacking section 20 including the supporting plate 2 is full of sheets 100. Thus, the plate spring 22 functions to limit the swing movement of the sheet supply roller KR1. Accordingly, even though the sheet stacking section 20 becomes full of sheets 100, the leading ends of the sheets 100 in the paper stacking section 20 are correctly contacted with the minute volleys and ridges 31 formed on the separating plate 3.

The holder 1A of the paper separating unit 1 is formed with a protrusion 1 protruding from a case cover 50, as shown in FIG. 2. By pushing the protrusion 1C, from the upper side of the facsimile apparatus A, toward the rear of the sheet feeding device 10 (i.e., a right-hand side direction in FIG. 2) against a force biasing the sheet supply roller KR1 toward the sheets 100, the sheet supply roller KR1 can be detached from the top sheet of the stack of sheets 100. Accordingly, even though a sheet jam occurs when the planetary gear PG meshes with the trailing gear TG (i.e., during a sheet feeding operation), the sheets 100 can be pulled out of the sheet feeding device 10 by pushing the protrusion 1C toward the rear of the sheet feeding device 10. That is, the sheets 100 can be pulled out without being obstructed by the sheet supply roller KR1.

In the sheet feeding device 10, a rear unit including the plate 2 and the separating plate 3 can be detached from a front unit including the paper separating unit 1 and associated driving components. As can be seen from FIG. 2, if the rear unit is detached from the sheet feeding device 10, the protrusion 1C contacts the case cover 50. This prevents the sheet supply roller KR1 from being extruded toward the rear of the sheet feeding device 10. This means that the sheet separating unit 1 can be located at a predetermined position even though the rear unit is not attached to the front unit.

With this configuration, it is prevented that the rear unit is improperly attached to the sheet feeding device 10. In addition, it is not necessary to press the sheet supply roller KR1 by hand against the force, acting on the sheet supply roller KR1, by the spring member 60 when the rear unit is attached to the sheet feeding device 10.

As shown in FIG. 3, the stepping motor 11 and the registration sensor 4 are connected to a controller 12. The controller 12 is connected to a personal computer (PC) through an interface 14. The stepping motor 11 is controlled by the controller 12. A detection signal generated by the registration sensor 4 is input to the controller 12. Sheet feeding operation and print operation are carried out under control of the controller 12 based on instructions transmitted by the PC 15. In FIG. 3, an operation unit 16 is also connected to the controller 12. As will be described later, by operating the operation unit 12, various commands including a type of sheet (e.g., plain paper, envelope, card or the like) on which printing is performed can be selected. Further, an NVRAM (Non-Volatile RAM) 13 and a ROM 17, which are also connected to the controller 12, are indicated by broken lines. The ROM 17 stores programs to be executed by the controller 12. Operations described hereinafter can be stored in the form of programs which can be executed by the controller 12. The NVRAM is used for storing various data necessary to perform controls described below.

Figure 5:
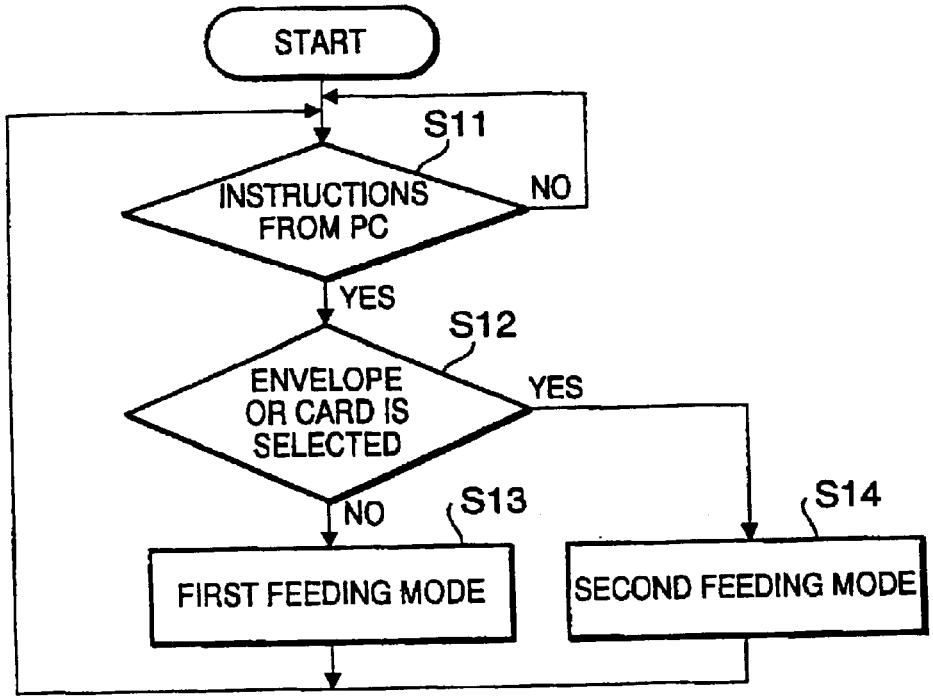
FIG. 5 is a flowchart showing a sheet feeding and printing operation according to a first embodiment of the invention.
Figure 6A:
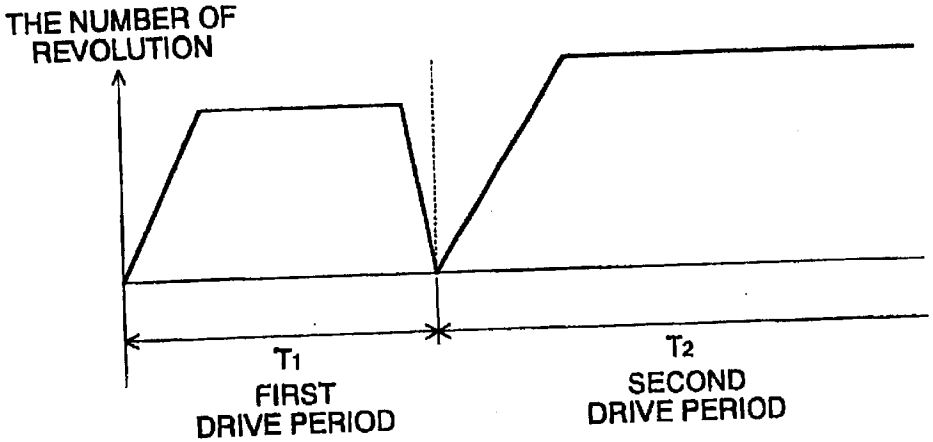
FIG. 6A is a timing chart showing a speed of a stepping motor in a first feeding mode according to the first-embodiment.
Figure 6B:
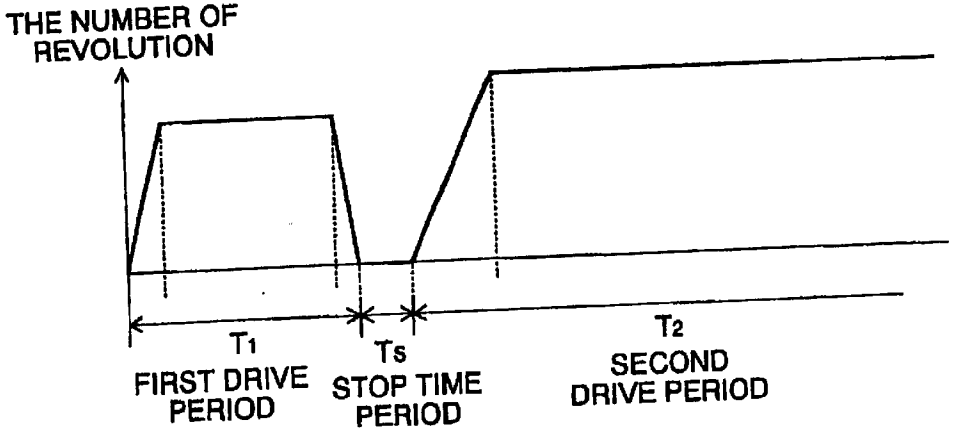
FIG. 6B is a timing chart showing a speed of the stepping motor in a second feeding mode according to the first embodiment.

Operation of the sheet feeding device 10 according to the first embodiment will be described below with reference to FIGS. 5, 6A and 6B. FIG. 5 is a flowchart showing sheet feeding operation and print operation. FIG. 6A is a timing chart showing a speed (the number of revolutions) of the stepping motor 11 in a first feeding mode. FIG. 6B is a timing chart showing a speed (the number of revolutions) of the stepping motor 11 in a second feeding mode.

In step S11, the controller 12 waits until an instruction initiating a print operation is received from the PC 15. When the instruction from the PC 15 is received (S11: YES), control proceeds to step S12, wherein the controller 12 judges whether or not an envelope or a card is selected, based on the instruction from the PC 15. If the envelope or the card is selected (S12:YES), control proceeds to step S14, where the second feeding mode is selected and performed. If the envelope or the card is not selected, i.e., a plain paper is selected (S12:NO), control proceeds to step S13 where the first feeding mode is selected and performed. After S13 or S14 is performed, control returns to S11.

FIG. 7 schematically shows various positions of a leading end of a sheet 100 along the sheet feed path 6. In FIG. 7, the sheet feed path 6 is indicated by a line, and positions Pos1, Pos3 and Pos 4 represent positions of the separating plate 3, the registration sensor 4, and the sheet feed roller 5, respectively. Position Pos2 represents a position at which the leading end 100A of the sheet 100 has just detached from the separating plate 3.

As shown in FIG. 6A, in the first feeding mode, the stepping motor 12 rotates in the first direction at a certain low speed P1 for a first drive period T1, then it stops momentarily, and then it rotates in the first direction at a higher speed P2 which is greater than the lower speed P1 for a second drive period T2. In the first time period T1, the leading end 100A of a sheet 100 moves from position Pos1 to position Pos2. The leading end 100A shown in FIG. 2 represents this condition. The stepping motor 11 stops momentarily between the first drive period T1 and the second drive period T2. With this configuration, i.e., to rotate the stepping motor 11 at the low speed P1 and to stop the stepping motor momentarily, the leading end 100A of the sheet 100 can be properly detached from the separating member 3.

In addition, since the stepping motor 11 momentarily stops, even though the sheet supply roller KR1 is lifted by an impact force of the sheet 100 detached from the separating plate 3, it is ensured that the sheet supply roller KR1 returns to a normal position during the momentary stop of the stepping motor 11.

This ensures that the leading end 100A of the sheet 100 is fed and moved away from the separating plate 3 when the second drive period T2 starts. Thus, the sheet 100 can be carried at the higher speed P2 during the second drive period T2. Accordingly, with this control, it becomes possible to feed the sheet 100 promptly and properly.

When the leading end 100A of the sheet 100 is detected by the registration sensor 4 in the second drive period (see Pos3 in FIG. 7) T2, by further feeding the sheet 100 by a predetermined amount, registration can be performed, i.e., the leading end portion of the sheet 100 is nipped by the sheet feed roller 5 (see Pos4 in FIG. 7).

For example, a speed for carrying the sheet 100 along the sheet feeding path 6 during the first drive period T1, which corresponds to the motor speed of P1, may be set at 2 IPS (Inch Per Sec), and a speed for carrying the sheet 100 along the sheet feeding path 6 during the second drive period T2, which corresponds to the motor speed of P2, may be set at 4 IPS. The motor speeds P1 and P2 may be, for example, 1200 pps (pulse per second) and 2400 pps, respectively.

It should be noted that, by feeding the sheet 100 at a lower speed, reliability of sheet separation increases. Therefore, in the first drive period T1, the stepping motor 11 is driven to rotate at a speed of P1, which is a relatively low speed. Once the top sheet is separated (i.e., detached from the sheet separation plate 3), it can be fed at a faster speed, and therefore, in the second drive period T2, the stepping motor 11 is controlled to rotate at a speed of P2 which is greater than P1.

In the above-described embodiment, the stepping motor 11 is stopped between the first and second drive periods T1 and T2. However, the invention is not limited to this configuration, and depending on an environment, the speed of the stepping motor 11 may be changed from P1 to P2 without completely stopping the stepping motor 11. Alternatively, depending on a case, there may be a longer period between the first and second drive periods.

As described above, in step S14, control of the sheet feeding device is performed in the second feeding mode. As shown in FIG. 6B, after the stepping motor 11 is driven at a certain low speed P1' in a first drive period T1, the stepping motor 11 is stopped for a predetermined stop time period Ts. In a second drive time period T2 after the predetermined stop time period Ts, the stepping motor 11 is driven in the first direction at a higher speed P2', which is higher than the lower speed P1'.

The sheet supply roller KR1 is stopped for the predetermined stop time Ts period between the first drive period T1 and the second drive period T2. This ensures that the leading end 100A of the sheet 100 is properly detached from the separating plate 3 even though an envelope or a card, which may easily cause a problem in the sheet separating operation, is used.

For example, a speed for carrying the sheet 100 along the sheet feed path 6 during the first drive period T1, which corresponds to the motor speed of P1', may be set at 1 IPS (Inch Per Sec), a speed for carrying the sheet 100 during the second drive period T2, which corresponds to the motor speed of P2', may be set at 4 IPS, and the predetermined stop time period may be set at 300 ms (0.3 s). The motor speed P1' and P2' may be, for example, 600 pps and 2400 pps, respectively.

As understood from the above, it is preferable that the speed P1' for separating a relatively thick sheet such as the envelope or card is slower than the speed P1 for separating a thin sheet such as the plain sheet.

With the above-described configuration, even though the leading end 100A of a sheet 100 is positioned at a volley portion formed on the separating plate 3, the sheet 100 is properly detached from the separating plate 3 before the second drive period starts.

Second Embodiment

Second embodiment of the present invention will be described with reference to FIGS. 8 and 9A–9E. In the second embodiment, the structure of the sheet feeding device is the same as that of the first embodiment shown in FIGS. 1–4B, but control of the sheet feeding device is different from that of the first embodiment.

FIG. 8 is a flowchart showing a sheet feeding and print operation of the sheet feeding device 10 according to the second embodiment.

The procedure shown in FIG. 8 starts, for example, when the facsimile device is powered ON. Initially, a variable N is set at 0 (S20). Then, preliminary sheet feeding operation starts in step S21. The preliminary sheet feeding operation stops after a certain period has elapsed (S22). It should be noted that the preliminary sheet feeding operation corresponds to the sheet feeding operation within the first drive period T1 in the first embodiment.

In step S23, it is judged whether the registration sensor 4 is ON (i.e., detects the presence of a sheet). It should be noted that the leading end 100A of the sheet is located at Pos2 in FIG. 7, while the registration sensor 4 is located at Pos3. Therefore, if the registration sensor 4 detects the sheet at this stage, a sheet which was not discharged from the sheet feed path 6 is detected. Therefore, if the registration sensor 4 is ON (S23:YES), i.e., if an error condition occurs, control proceeds to step S28. If the registration sensor 4 is OFF (S23:NO), control proceeds to step S24.

In step S24, main sheet feeding operation starts. This main sheet feeding operation corresponds to the second drive period T2 in the first embodiment. Then, it is judged whether the registration sensor 4 is switched to ON or not in the main sheet feeding operation (S25). As understood from FIG. 7, when the main sheet feeding operation starts, the leading end 100A of the sheet 100 moves from Pos2 to Pos4, Pos3 being the sensor position. In this specification, after a time period Tt has passed since the leading end 100A started from Pos2, and before it reaches the sheet feed roller 5 (i.e., Pos4), a through-down mode starts, in which the sheet feed speed is gradually descreased. Since the registration sensor 4 is located between Pos2 and Pos4, the leading end 100A of the sheet 100 should be detected before the leading end 100A reaches Pos4.

In S25, it is judged whether the registration sensor 4 is switched ON until the through-down mode starts (within time period Tt after the main sheet feeding operation stats). In other words, it is judged whether the registration sensor 4 is switched ON within the time period Tt. If it is judged that the registration sensor 4 is switched ON within the time period Tt (S25:YES), which is a normal operating condition, control proceeds to S26.

If it is judged that the registration sensor 4 is not switched ON before the time period Tt elapses (S25:NO), and is switched ON after the through-down mode starts (i.e., Tt has elapsed) (S30:YES), it is judged that an error occurs, and control proceeds to step S28.

If it is judged that the registration sensor 4 is not switched ON even in the through-down mode (S30:NO), it is determined that a "pick up error" occurs, and control returns to step S21.

As shown in FIG. 8, N is incremented by 1 in step S31, and then it is judged whether N is 3 is step S32. Therefore, if the registration sensor 4 is not switched ON while steps S21–S30 is repeated three times (S32:NO), control proceeds to S33 where error message indicating the occurrence of the "pick up error" or "out of sheet" is, and the sheet feeding and print operation is terminated.

In step S26, i.e., under normal operating condition, the sheet 100 is fed to a position where the sheet feed roller 5 catches the paper (S26). Next, printing operation and ejection operation are performed in the usual way in step S27. Then, the sheet feeding and print operation terminates.

If it is determined that an error occurs in step S23 or step S30, then the sheet 100 is fed to a position where the sheet feed roller 5 catches the paper (S28). Next, in step S29, the sheet 100 is discharged without performing the printing operation. Then, control returns to step S21. If an error occurs during the sheet feeding operation, a proper print operation can not be performed. In such a case, the sheet 100 is discharged without performing the printing operation, according to above-mentioned control shown in FIG. 8.

Figures 9A, 9B, 9C, 9D, 9E:
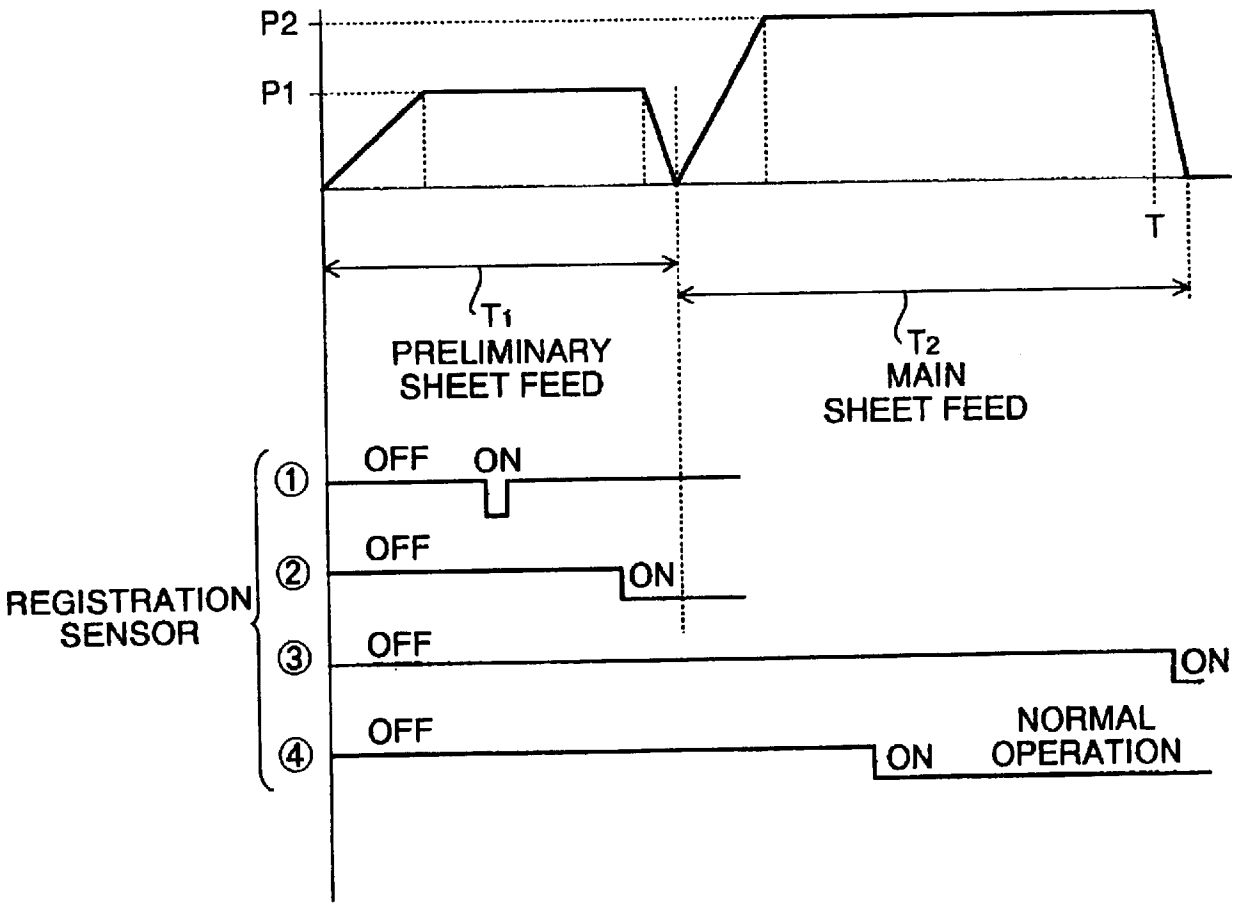

FIG. 9A is a timing chart showing operation of the stepping motor 11 according to the control shown in FIG. 8. As shown in FIG. 9A, the stepping motor 11 is driven at a certain low speed P1 in time period T1 (i.e., in the preliminary sheet feeding operation). After the momentary stop, the stepping motor 11 is driven at a high speed P2 in a time period T2 (i.e., in the main sheet feeding operation).

FIGS. 9B–9E show four examples of signals output by the registration sensor 4, respectively. The signals output by the registration sensor 4 are negative pulses (i.e., the low-level represents the ON status of the registration sensor 4).

As shown in FIG. 9B, if the registration sensor 4 is switched to ON before the preliminary sheet feeding operation terminates due to, for example, mechanical vibrations, it is not judged that an error occurs, according to the control shown in FIG. 8.

As shown in FIG. 9C, if it is judged that the registration sensor 4 is switched ON when the preliminary sheet feeding operation terminates, then it is determined that an error occurs.

As shown in FIG. 9D, if it is judged that the registration sensor 4 is switched ON in the through-down mode, then it is determined that an error occurs.

As shown in FIG. 9E, only when the registration sensor 4 is switched ON during the main sheet feeding operation, it is judged that the sheet feeding device operates under normal conditions.

As described above, the sheet is discharged without performing the printing operation when it is judged that an error occurs, according to the second embodiment. Accordingly, it becomes possible to prevent performing a print operation under conditions where sheet feeding operation is inadequately performed.

In the second embodiment, when an error occurs, sheet is discharged so that the print operation is not performed. It is possible to modify the control such that, when an error occurs, another operation other than the discharge of the sheet may be performed.

Third Embodiment

Third embodiment of the present invention will be described with reference to FIGS. 10A–10C. In the third embodiment, the structure of the sheet feeding device is the same as the first embodiment, but control of the sheet feeding device is different from that of the first embodiment.

In the third embodiment, a normal sheet feeding operation mode, a first stable sheet feeding operation mode and a second stable sheet feeding operation mode are provided. The sheet feeding device 10 is set to the normal sheet feeding operation mode initially. When a predetermined operation is performed through the operation unit 16 of the facsimile apparatus A, which unit is connected to the controller 12, by an user, the normal feed operation is switched to the first stable feed operation.

FIGS. 10A–10B are timing charts showing control of the stepping motor 11 in the normal sheet feeding operation mode, according to the third embodiment of the present invention.

As shown in FIG. 10A, when a plain paper is selected by printer driver software running on the PC 15, the stepping motor 11 is driven at a pulse frequency of about 2100 pps (pulses per second), and therefore the sheet supply roller KR1 is rotated at a speed corresponding to the pulse frequency of 2100 pps.

As shown in FIG. 10B, when a relatively thick paper, such as an envelope, is selected by printer driver software running on the PC 15, the stepping motor 11 is driven at a pulse frequency of about 1500 pps, and therefore the paper supply roller KR1 is rotated at a speed corresponding to the pulse frequency of 1500 pps.

As described above, when a relatively thick paper is selected, the stepping motor 11 is driven at a lower speed than a case where the plain paper is selected. This is based on the fact that a lower speed stabilizes the sheet feed operation and is preferable for relatively thick paper.

There may be a case where leading ends of sheets stacked in the sheet stacking section are crooked or curved. In such a case, "sheet feeding error" occurs easily at the initial stage of the sheet feeding operation. Even though such a case occurs, an user can select the stable sheet feeding operation, which is shown in FIG. 10C, and can prevent occurrence of a "sheet feeding error."

FIG. 10C is a timing chart showing control of the stepping motor 11 in the first stable sheet feeding operation mode, according to the third embodiment of the present invention. While two different speeds of 2100 pps and 1500 pps are used in the normal sheet feeding operation mode in accordance with the type of the paper, only one speed is used in the first stable sheet feeding operation mode regardless of the types of the sheet. In addition, control of the stepping motor 11 is divided into two stages in the first stable sheet feeding operation mode.

As shown in FIG. 10C, in a first drive period T1, the sheet supply roller KR1 is driven at a relatively low speed P1 so that the sheet 100 is fed steadily. In this example, P1 equals to a pulse frequency of 900 pps. The sheet 100 is separated from the separating plate 3 within the first drive period. After the first drive period terminates, with a momentary stop of the stepping motor 11, a second drive period starts. In the second drive period, the sheet supply roller KR1 is driven at a relatively high speed P2. In this example, P2 equals to a pulse frequency of 1500 pps so that the sheet is fed quickly.

With this configuration, the sheet 100 is properly fed along the feeding direction even though the leading end of a sheet 100 stacked in the paper stacking section are crooked or curved.

It should be appreciated that an operation of reverse rotation of the sheet supply roller KR1 may be performed in addition to the control of the paper supply roller KR1 shown in FIG. 10C.

In this embodiment, the controller 12 is configured to detect a "sheet feeding error", and to count the number of occurrences of the "sheet feeding error." Further, the controller 12 is configured to switch from the normal sheet feeding operation mode to the stable sheet feeding operation mode when the number of errors reaches a predetermined number.

The sheet feeding device is set to the normal sheet feeding operation mode initially. When the number of occurrences of the "sheet feeding error" reaches 1000, the normal sheet feeding operation mode is automatically switched to the stable sheet feeding operation.

FIGS. 11A and 11B are timing charts which are identical to those shown in FIGS. 10A and 10B.

FIG. 11C is a timing chart showing control of the stepping motor 11 in the second stable sheet feeding operation mode, according to the third embodiment of the present invention.

In the first driving period T1, the stepping motor is driven at a pulse frequency of P1 (900 pps). Then, the stepping motor 11 is stopped for the certain stop period Ts, for example, 0.3 s. Next, the second driving period T2 starts, wherein the stepping motor 11 is driven at a pulse frequency of P2 (1500 pp).

Since the stepping motor 11 is driven at speed P1 during the first driving period, the leading end 100A of the sheet 100 is properly detached from the separating plate 3. In addition, since the stepping motor 11 stops for the stop period Ts, the leading end 100A of the sheet 100 stays at Pos2 (see FIG. 7) where the leading end 100A has just detached from the separating plate 3. Accordingly, even though the sheet supply roller KR1 is lifted by an impact force of the sheet 100 detached from the separating plate 3, the sheet supply roller KR1 returns to a normal position during the stop period Ts.

According to the third embodiment, the control of the stepping motor in the stable sheet feeding operation may be performed when "sheet feeding error" continuously occurs a predetermined-times even though the number of the occurrence of the "sheet feeding error" does not reach 1000.

FIG. 12 is a flowchart showing the sheet feeding operation of the sheet feeding device, according to the third embodiment of the present invention, which is performed under control of the controller 12.

At first, the controller 12 judges whether the number of occurrences of the "sheet feeding error" is equal to or greater than 1000 (S51). The number of occurrence is accumulatively stored in an NVRAM 13 (see FIG. 3) connected to the controller 12. It should be noted that the number of occurrence of the "sheet feeding error" stored in the NVRAM is set to 0 when the sheet feeding device is used for the first time.

If the number of occurrence is less than 1000 (S51:NO), control proceeds to step S52 where it is judged whether the first stable sheet feeding operation mode is selected by the user.

If the first stable sheet feeding operation mode is not selected by the user (S52:NO), the stepping motor 11 is driven in the normal sheet feeding operation mode as shown in FIG. 10A or 10B (S53). In step S53, the sheet supply roller KR1 rotates, and therefore, a top sheet of the sheets 100 in the paper stacking section is fed to inside the facsimile apparatus A.

After the sheet supply roller KR1 rotates a predetermined number of times, the controller 12 judges whether a "sheet feeding error" occurs or not. This judgment is made, for example, by judging whether the leading end 100A of the sheet 100 is detected by the registration sensor 4 (S54). If the leading end 100A is not detected by the registration sensor 4 even though the sheet supply roller KR1 rotates the predetermined number of times, then the controller 12 judges that the "sheet feeding error" occurs (S54:YES). Next, the controller 12 increments the number of occurrences of the "sheet feeding error" which is stored in the NVRAM by one (S55).

Then, the controller 12 judges whether the "sheet feeding error" continuously occurred by a predetermined number of times during the present sheet feeding operation for feeding one sheet 100 (S56). If it is determined that the "sheet feeding error" occurred continuously by the predetermined number of times (S56:YES), the controller 12 starts feeding the sheet 100 in the second stable sheet feeding operation mode which is shown in FIG. 11C (S57), and then sheet feeding operation terminates. Therefore, the sheet is properly fed to inside the facsimile apparatus A. After the sheet feed operation described above, the controller 12 can perform print operation.

If it is determined that the "sheet feeding error" does not occur the predetermined number of times continuously (S56:NO), control returns to step S53.

If it is determined that the "sheet feeding error" does not occur (S54:NO), the sheet feeding operation terminates.

If it is determined that the first stable sheet feeding operation mode is selected by the user (S52:YES), the stepping motor 11 is driven in the first stable sheet feeding operation mode which is shown in FIG. 10C (S58).

If it is determined that the number of occurrences of the "sheet feeding error" is equal to or greater than 1000 (S51:YES), the stepping motor 11 is driven in the second stable sheet feeding operation mode shown in FIG. 11C (S58).

According to the third embodiment, occurrence of "sheet feeding error" is prevented properly even though distortion of the paper supply roller KR1 occurs due to aged deterioration. In addition the user can select the first stable sheet feeding operation mode using the operation unit 16 (see FIG. 7) connected to the controller A computer program for performing the above-mentioned sheet feeding operation shown in FIG. 12 is stored in a ROM 17 (see FIG. 7) connected to the controller 12. The controller 12 performs the sheet feeding operation shown in FIG. 12 according to the computer program stored in the ROM 17.

Variations of the third embodiment will be described with reference to FIGS. 13A, 13B, 14A–14D and 15A–15G.

FIGS. 13A and 13B show modifications of the first stable sheet feeding operation mode shown in FIG. 10C. As shown in FIG. 13A, in a first drive period T1, the sheet supply roller KR1 is driven at a relatively low speed corresponding to a pulse frequency of P1 (900 pps). After the first stage terminates, a second drive period starts without the momentary stop of the motor 11. In the second drive period T2, the paper supply roller KR1 is driven at a relatively high speed corresponding to a pulse frequency of P2 (1500 pps).

A modification of the first stable sheet feeding operation mode shown in FIG. 13B is similar to the control of the stepping motor 11 shown in FIG. 11C.

Figure 14A:
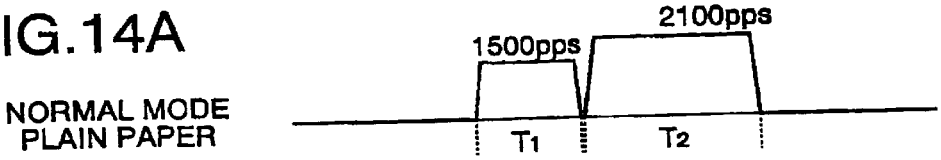
Figure 14B:
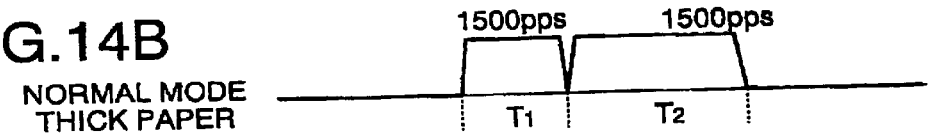

FIGS. 14A and 14B are timing charts showing modifications of the control of the stepping motor 11 in the normal sheet feeding operation mode shown in FIGS. 10A and 10B, respectively. As shown in FIGS. 14A and 14B, the control of the stepping motor 11 is divided into two stages. When the ordinary paper is selected and the first stable sheet feeding operation mode is selected, the stepping motor 11 is driven according to the control shown in FIG. 14A. When the relatively thick paper is selected and the first stable sheet feeding operation mode is selected, the stepping motor 11 is driven according to the control shown in FIG. 14B.

Figure 14C:
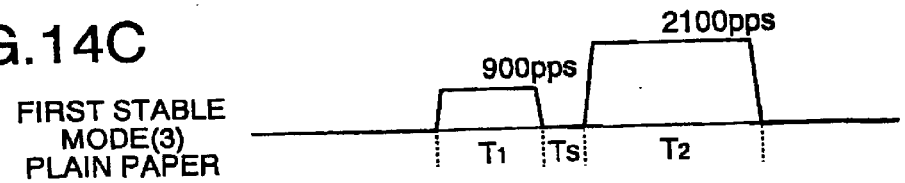
Figure 14D:
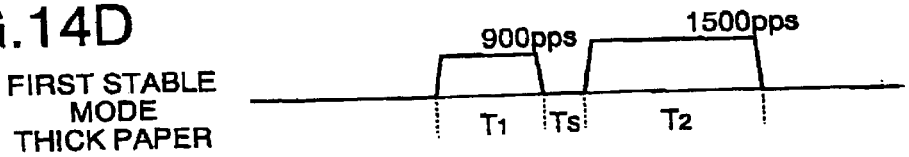
Figure 15A:
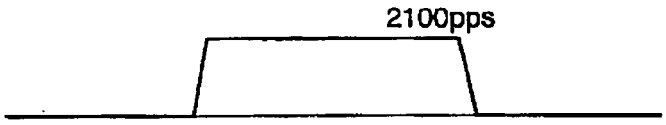
Figure 15B:
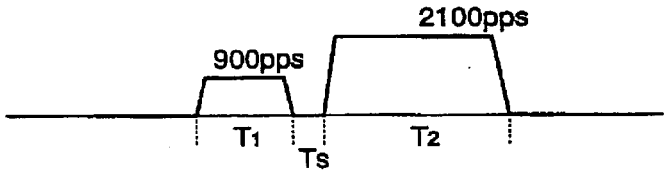
Figure 15C:
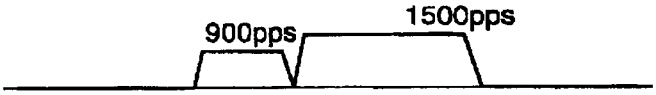
Figure 15D:
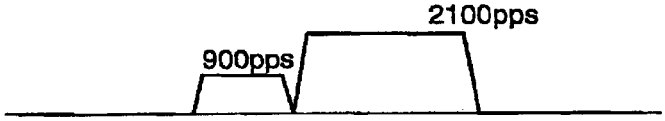
Figure 15E:
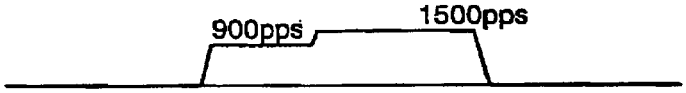
Figure 15F:
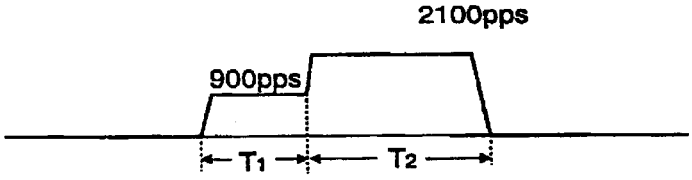
Figure 15G:
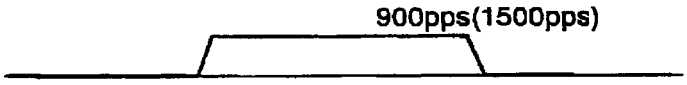

FIGS. 14C and 14D are timing charts showing modifications of the control of the stepping motor 11 in the first stable sheet feeding operation mode shown in FIG. 10C. When the plain paper is selected and the first stable sheet feeding operation mode is selected, the stepping motor 11 is driven according to the control shown in FIG. 14C. When the relatively thick paper is selected and the first stable sheet feeding operation mode is selected, the stepping motor 11 is driven according to the control shown in FIG. 14D.

FIGS. 15B–15G show modifications of the second stable sheet feeding operation mode shown in FIG. 11C. The control of the stepping motor 11 when the plain paper is selected and the second stable sheet feeding operation mode is not selected, which is shown in FIG. 11A, is shown again in FIG. 15A for reference purposes.

In the above description, the sheet feeding devices are described as those for an inkjet printer implemented in a facsimile device. However, the invention is not limited to this configuration, and the sheet feeding device according to the embodiment can be one for a stand-alone printer.

Further, in the above description, the sheet feeding devices are described as those for an inkjet printer. However, the invention is not limited to this configuration, and the sheet feeding device according to the embodiment can be employed in other devices such as a scanner or the like.

Furthermore, various modifications with regard to the flowchart of the sheet feeding operation shown in FIG. 12 can be made.

For example, if the sheet feeding device is out of sheet after the first stable sheet feeding operation mode is selected in step S32, the controller 12 may switch the first stable sheet feeding operation mode to the normal sheet feeding operation mode.

Control may proceed to step S7 after "sheet feeding error" is detected only once in step S4 (S4:YES).

The number of occurrences of the "sheet feeding error" stored in the NVRAM may be reset to 0 when the sheet supply roller KR1 is replaced with the new one.

Alternatively or optionally, by using the number of occurrences of the "sheet feeding error" in order to judge whether the normal sheet feeding operation mode is to be switched to the second stable sheet feeding operation mode, a rate of occurrence of "sheet feeding error" in a predetermined time period or a rate of occurrence of "sheet feeding error" since the sheet feeding device was used for the first time may be used.

According to the sheet feeding operation shown in FIG. 12, the control method of the stepping motor 11 is changed either in response to the user operation or in response to the accumulated number of occurrences of the "sheet feeding error." This configuration may be modified such that the control is changed in response to only one of the user operation or the accumulated number of occurrences of the "sheet feeding error."

The present disclosure relates to the subject matters contained in Japanese Patent Applications No. 2001-256503, filed on Aug. 22, 2001, and No. 2001-250935, filed on August 27, which are expressly incorporated herein by reference in their entireties.

What is claimed is:

1. A sheet feeding device which feeds a stack of sheets one by one along a sheet feed path, comprising:

a sheet driving member that separates and drives one sheet of the stack of sheets in the sheet feed direction; and a control system that controls the sheet driving member to move the one sheet at least in a first mode that is followed by a second mode, the control system controlling the sheet driving member to move the one sheet at a first speed in the first mode, and to move the one sheet at a second speed in the second mode, the first speed being slower than the second speed, wherein a predetermined stop time is provided between the first mode and the second mode, and the sheet driving member stops moving the one sheet during the predetermined stop time.

2. The sheet feeding device according to claim 1, wherein the predetermined stop time is varied in accordance with a thickness of the sheet to be fed.

3. A sheet feeding device which feeds a stack of sheets one by one along a sheet feed path, comprising:

a sheet driving member that separates and drives one sheet of the stack of sheets in the sheet feed direction; and a control system that controls the sheet driving member to move the one sheet at least in a first mode that is followed by a second mode, the control system controlling the sheet driving member to move the one sheet at a first speed in the first mode, and to move the one sheet at a second speed in the second mode, the first speed being slower than the second speed wherein at least one of the first and second speed is changed in accordance with a thickness of the sheet to be fed.

4. A sheet feeding device which feeds a stack of sheets one by one along a sheet feed path, comprising:

a sheet driving member that separates and drives one sheet of the stack of sheets in the sheet feed direction; and a control system that controls the sheet driving member to move the one sheet at least in a first mode that is followed by a second mode, the control system controlling the sheet driving member to move the one sheet at a first speed in the first mode, and to move the one sheet at a second speed in the second mode, the first speed being slower than the second speed; and a separating plate located on a downstream side, with respect to a sheet feed direction of the stack of sheets, leading ends of the stack of sheets being abutted against a surface of the separating plate, the surface of the separating plate having a rough surface, wherein the one sheet is a top sheet of the stack of sheets, the sheet driving member contacting the top sheet of the stack of sheets, the sheet driving member being driven to move the top sheet in the sheet feed direction.

5. The sheet feeding device according to claim 4, which is configured to feed the leading end of the top sheet from a first position which is on the sheet separating plate to a predetermined registration position, the leading end being detached from the sheet separating plate located at a second position at an end of drive in the first mode, the leading end being moved from the second position to the predetermined registration position during the second mode.

6. The sheet feeding device according to claim 5, further provided with a registration sensor that detects absence/presence of a sheet, the registration sensor being provided at a third position which is located between the second position and the predetermined registration position.

7. The sheet feeding device according to claim 6, wherein the control system judges an occurrence of a sheet feed error based on the operation mode and a status detected by the registration sensor.

8. The sheet feeding device according to claim 6, wherein, if the registration sensor detects presence of a sheet at the end of operation in the first mode, the control system judges an occurrence of a sheet feed error.

9. The sheet feeding device according to claim 6, wherein, if the registration sensor does not detect presence of a sheet by the end of operation in the second mode, the control system judges an occurrence of a sheet feed error.

10. A sheet feeding device which feeds a stack of sheets one by one along a sheet feed path, comprising:

a sheet driving member that separates and drives one sheet of the stack of sheets in the sheet feed direction; and a control system that controls the sheet driving member to move the one sheet from a stacked position to a predetermined registration position, the control system being selectively operated in a first feeding mode and a second feeding mode, wherein the control system controls the driving member to move the one sheet in a first mode that is followed by a second mode when the first feeding mode is selected, the control system controlling, in the first feeding mode, the sheet driving member to move the one sheet at a first speed in the first mode and to move the one sheet at a second speed in the second mode, the first speed being slower than the second speed, and the control system controls the driving member substantially at a constant speed in the second feeding mode.

11. A sheet feeding device which feeds a stack of sheets one by one along a sheet feed path, comprising:

a sheet driving member that separates and drives one sheet of the stack of sheets in the sheet feed direction; and a control system that controls the sheet driving member to move the one sheet from a stacked position to a predetermined registration position, the control system being selectively operated in a first feeding mode and a second feeding mode, wherein the control system controls the driving member to move the one sheet in a first mode that is followed by a second mode when the first feeding mode is selected, the control system controlling, in the first feeding mode, the sheet driving member to move the one sheet at a first speed in said first mode and to move the one sheet at a second speed in said second mode, the first speed being slower than the second speed, and the control system controls the driving member to move the one sheet in a third mode that is followed by a fourth mode when the second feeding mode is selected, and the control system controls, in the second feeding mode, the sheet driving member to move the one sheet at a third speed in the third mode, and the sheet driving member to move the one sheet at a fourth speed in the fourth mode.

12. The sheet feeding device according to claim 11, wherein the third speed is slower than the second speed.

13. The sheet feeding device according to claim 10, wherein at least one of the constant speed, first speed and second speed is changed depending on a thickness of a sheet to be fed.

14. The sheet feeding device according to claim 10, wherein a predetermined stop time is provided between the first mode and the second mode, and the sheet driving member stops moving the one sheet during the predetermined stop time.

15. The sheet feeding device according to claim 14, wherein the predetermined stop time is varied in accordance with a thickness of the sheet to be fed.

16. The sheet feeding device according to claim 10, further comprising:

a sheet feed error detection system; and a storage that accumulatively stores the number of occurrences of the sheet feed error.

17. The sheet feeding device according to claim 16, wherein the control system selects one of the first feeding mode and the second feeding mode in accordance with the accumulated number of occurrences of the sheet feed error.

18. The sheet feeding device according to claim 17, wherein the control system selects the first feeding mode if the number of occurrences of sheet feed errors reaches a predetermined value.

19. A method of feeding a stack of sheets one by one from the stack to a predetermined registration position along a sheet feed path of a sheet feeding device, comprising:

driving one sheet of the stack of sheets in the sheet feed direction to a position upstream of the predetermined registration position at a first speed;

stopping the movement of the one sheet for a predetermined period of time; and driving the one sheet in the sheet feed direction to the predetermined registration position at a second speed which is different from the first speed.

20. The method according to claim 19, wherein the first speed is slower than the second speed.

* * * * *